US011162282B2

(12) United States Patent
Kinnich

(10) Patent No.: US 11,162,282 B2
(45) Date of Patent: Nov. 2, 2021

(54) APPARATUS AND SYSTEM FOR SECURING A RIDEABLE BOARD TO A FIXED OBJECT

(71) Applicant: David Kinnich, Chicago, IL (US)

(72) Inventor: David Kinnich, Chicago, IL (US)

( * ) Notice: Subject to any disclaimer, the term of this patent is extended or adjusted under 35 U.S.C. 154(b) by 325 days.

(21) Appl. No.: 16/254,402

(22) Filed: Jan. 22, 2019

(65) Prior Publication Data

US 2019/0226244 A1 Jul. 25, 2019

Related U.S. Application Data

(60) Provisional application No. 62/619,678, filed on Jan. 19, 2018.

(51) Int. Cl.

| | |
|---|---|
| ***E05B 73/00*** | (2006.01) |
| ***E05B 67/06*** | (2006.01) |
| ***A63C 17/00*** | (2006.01) |
| *A63C 17/01* | (2006.01) |

(52) U.S. Cl.

CPC ..... *E05B 73/0094* (2013.01); *A63C 17/0006* (2013.01); *A63C 17/0013* (2013.01); *E05B 67/063* (2013.01); *A63C 17/012* (2013.01)

(58) Field of Classification Search

CPC ..... E05B 67/06; E05B 67/063; E05B 73/00; E05B 73/007; E05B 73/0094; A63C 17/0006; A63C 17/0013; A63C 17/002; A63C 17/012

See application file for complete search history.

(56) References Cited

U.S. PATENT DOCUMENTS

| | | | | |
|---|---|---|---|---|
| 4,674,306 | A * | 6/1987 | Halpern | B62H 5/14 70/233 |
| 4,773,239 | A * | 9/1988 | Lowe | E05B 73/0094 70/38 A |
| 5,040,385 | A | 8/1991 | Randone | |
| 5,179,847 | A * | 1/1993 | Dorn | E05B 73/0005 280/809 |
| 5,709,113 | A * | 1/1998 | Godfrey | E05B 67/063 70/227 |
| 5,769,438 | A | 6/1998 | Svetlov | |
| 5,901,588 | A | 5/1999 | Frost | |
| 6,230,526 | B1 | 5/2001 | Fontes et al. | |
| 6,293,412 | B1 * | 9/2001 | Draper | E05B 73/00 211/4 |
| 6,360,405 | B1 | 3/2002 | McDaid et al. | |

(Continued)

*Primary Examiner* — Christopher J Boswell

(74) *Attorney, Agent, or Firm* — Neal, Gerber & Eisenberg LLP

(57) ABSTRACT

Described herein are systems and apparatuses for securing and locking a ride-able board to a fixed object. In general, a ride-able board may optionally include a planar body configured for moving across a solid surface and for carrying a rider. In general, a ride-able board may include a planar body mounted to a steering apparatus and any number of wheels. In a preferred embodiment, the security device containing a shackle and housing comprising an open cavity is used to secure the board to any fixed object. In a preferred embodiment, the housing cavity slides over the steering apparatus and has two openings for each end of the shackle. The lock secures the shackle in place and prevents the removal of the board from the fixed object. The housing working in conjunction with the u-shackle prevents removal of the locking device from the board.

20 Claims, 8 Drawing Sheets

(56) References Cited

U.S. PATENT DOCUMENTS

| | | | | |
|---|---|---|---|---|
| 6,374,645 | B1 * | 4/2002 | Fontes | E05B 73/0005 280/809 |
| 6,481,581 | B2 * | 11/2002 | Sipe | E05B 73/00 211/4 |
| 6,640,978 | B2 * | 11/2003 | Reiser | E05B 73/00 211/4 |
| 6,978,902 | B2 * | 12/2005 | Loch | E05B 73/0094 211/20 |
| 9,834,960 | B2 * | 12/2017 | Chesterton | E05B 73/0094 |
| 9,878,230 | B1 * | 1/2018 | Seele | A63C 17/26 |
| 2005/0028571 | A1 | 2/2005 | Merrem et al. | |
| 2005/0142961 | A1 | 6/2005 | Tan | |
| 2005/0150262 | A1 | 7/2005 | Murray et al. | |
| 2006/0108296 | A1 | 5/2006 | Loch | |
| 2008/0173596 | A1 | 7/2008 | Loch | |
| 2013/0081891 | A1 | 4/2013 | Ulmen et al. | |
| 2013/0305790 | A1 | 11/2013 | Seele et al. | |
| 2014/0265200 | A1 * | 9/2014 | Signorelli | A63C 17/26 280/87.042 |
| 2014/0266588 | A1 | 9/2014 | Majzoobi | |
| 2014/0277888 | A1 | 9/2014 | Dastoor et al. | |
| 2016/0348403 | A1 | 12/2016 | Denny | |
| 2018/0104567 | A1 | 4/2018 | Treadway et al. | |
| 2018/0236348 | A1 | 8/2018 | Evans et al. | |
| 2019/0091551 | A1 | 3/2019 | Rautiainen et al. | |
| 2019/0091552 | A1 | 3/2019 | Bluhm et al. | |
| 2019/0091553 | A1 | 3/2019 | Rautiainen et al. | |
| 2019/0184265 | A1 | 6/2019 | Micacchi | |
| 2019/0226244 | A1 | 7/2019 | Kinnich | |
| 2020/0075924 | A1 | 3/2020 | Kinnich | |

* cited by examiner

APPARATUS AND SYSTEM FOR SECURING A RIDEABLE BOARD TO A FIXED OBJECT

CROSS-REFERENCE TO RELATED APPLICATIONS

This application claims benefit of the filing date of and right of priority to U.S. Provisional Application No. 62/619,678, filed Jan. 19, 2018.

FIELD OF THE INVENTION

This invention relates generally to locking devices, more specifically to a locking apparatus for securing a ride-able board, and in particular to security and locking devices for skateboards, longboards, electric powered skateboards and other types of ride-able boards.

BACKGROUND OF THE INVENTION

Ride-able boards are a form of recreation or transportation where a rider rides on a board on pavement, asphalt, roads, paths, dirt, gravel or other hard surfaces. Ride-able boards can include skateboards, longboards, mountain boards, electric longboards, electric skateboards, gas or wind powered skateboards and longboards as well as other devices. Longboarding is a board activity in which the rider, termed a boarder, rides on the pavement or other hard surface. Typically, riders use a longboard or an electric longboard as a form of recreation as well as transportation.

Longboards and other ride-able boards are a popular method of transportation and recreation. They are also appealing to thieves, therefore security measures must be taken to protect the board. Riders must constantly carry or monitor their ride-able boards to avoid theft. This can be inconvenient as many places do not allow people to bring their ride-able boards into the establishment. Robust security devices for skateboards and other ride-able boards are virtually non-existent. Some existing security devices use a cable to loop around the truck and/or a fixed object. Standard cables are also easily cut by bolt cutters. Some existing devices are also unable to work with standard longboard trucks, also referred to as reverse kingpin trucks, and the majority of electric powered longboards also use reverse kingpin trucks. Other security devices are mounted to the skateboard with standard nuts and bolts. This often requires altering the form and function of skateboard by changing the weight distribution and height of the trucks. These types of security devices can easily be removed with standard tools. Preventing removal requires the use of security nuts and bolts, which makes repair and replacement of the trucks difficult. Existing security devices are unable to limit access to the nuts and bolts or other fasteners attaching the truck to the skateboard. Existing security devices are generally unable to use a U-lock shackle and generally use a cable locking system. Security devices and locking systems are also generally cumbersome and hard to carry with a large cable that has to be wrapped up and stored for transport.

Thus, there is a need for an improved and useful apparatus and system for locking and securing ride-able boards to a fixed object. This invention provides such and improved and useful apparatus and system.

BRIEF SUMMARY OF THE INVENTION

Described herein are apparatuses and systems for locking and securing a ride-able board to a fixed object. In general, a ride-able board may optionally include a planar body configured for moving across a solid surface and for carrying a rider. In general, a ride-able board may include a steering apparatus coupled to a bottom portion of a planar body. In general, a ride-able board may include at least one wheel attached to the steering apparatus. In general, a locking device may secure the steering apparatus between the board and wheel and connect to a shackle to prevent theft or removal of the board from the object.

In some embodiments, the planar body may be a skateboard or longboard. In some embodiments the steering apparatus is a set of trucks. In some embodiments, the skateboard locking device includes a shackle made of material that would prevent easy cutting and a housing to limit access to the nuts and bolts (or other fasteners) attaching the truck to the board. A shackle refers to a solid piece having legs and an opening between ends of the legs. For example, a shackle can be a U-shaped piece, and is typically made with a strong material, such as metal. The shackle is configured to be secured with a lock (a clevis pin or bolt) across the opening of the U-shaped body. In some embodiments, the locking device includes a U-shackle, a housing, and a locking mechanism. In some embodiments, the U-shackle has two legs and forms the shape of a capital U—a loop with two free ends. In some embodiments, one of the free ends is bent to form a foot at a right angle, which can be inserted into the housing at an angle, but cannot be removed while locked. In some embodiments, the other free end is adapted with a slot, hole or other means to engage the locking mechanism. In some embodiments, the housing covers the top of the truck mounting nuts that attach the trucks to the skateboard at either end of the underside of the board. In some embodiments, the housing extends on either side, past the trucks, under the wheels, towards the end of the skateboard. In some embodiments, the housing has a key or pin that sticks or juts out at the end of the housing. In some embodiments, this acts to secure the bottom of the kingpin bolt to prevent removal or punching out. In some embodiments, different key heights are elevated to work with the different truck mounting locations that are prevalent: drop through vs. traditional. In an embodiment with two keys or pins, the top key or pin works if the trucks are mounted under the board and the bottom key or pin works if they are mounted on a drop-through board. In some embodiments, the housing has four stops along the base partially raised to accommodate the width of the truck, they elevate the housing on top of the trucks and increase stability and security as well as helping to hold the housing in place. In some embodiments, each of the stops has a recessed cavity that the bolt or other fastener resides in when the housing is in place. In some embodiments, this functions with the kingpin key to provide a stopping mechanism once the shackle is in place. In some embodiments, the housing has two openings, each adapted to receive a different one of the shackle's free ends. In some embodiments, one of the housing's openings interfaces with the locking mechanism. In some embodiments, the locking mechanism is adapted to accept a key. In some embodiments, rotating the key switches between engaging and disengaging the locking mechanism with the free end of the shackle.

In some embodiments, the housing wraps around one of the trucks and covers the mounting nuts, which attach the trucks to the ride-able board deck. In some embodiments, the housing is made of a solid material and has an open cavity, limiting access to the truck bolts and nuts. In some embodiments, the housing extends from one side of the trucks to the other, where the shackle is inserted. In some embodiments, the skateboard locking device is secured while in use by the housing on one side of the truck with the kingpin key and by the shackle on the other side of the truck hanger. In some embodiments, the housing and the shackle are securely connected to each other at the interface of the shackle and housing. In some embodiments, the bent leg of the shackle forms a L-hook and fits into one end of the housing. In some embodiments, the other end of the housing includes the locking mechanism that engages the other end of the shackle. In some embodiments, the shackle can be made of strengthened steel and bent into the shape.

In some embodiments, the skateboard locking device can be used to secure a ride-able board to a fixed object by placing the housing around one of the trucks on the underside of the board. In some embodiments, the shackle is then placed around a bike rack, pole, or other object, and inserted into the openings of the housing. In some embodiments, then a key is inserted into the locking mechanism and rotated to engage and lock the shackle. In some embodiments, once the shackle is in place the housing and shackle form a fixed angle which secures the truck and board in place, even if the kingpin nut is removed the bolt stays in place and the truck hanger cannot be pulled off to remove the lock. In some embodiments, the skateboard locking device can be removed in the opposite order by disengaging the locking mechanism, removing the shackle, and removing the housing. It is the presently preferred embodiment however it should be understood it doesn't need to be. In some embodiments, the housing and u-lock shackle can be manufactured from various materials i.e.—different metals (aluminum, steel, iron, etc.) composite blends, carbon fiber, etc. In some embodiments, the kingpin keys can be shaped differently or made in a different arrangement. In some embodiments, the housing comprises more than one kingpin key to adapt to different board and truck variations. In some embodiments, the angle made with the housing and shackle when securely connected to each other will be 90-degrees. In some embodiments, the angle made with the housing and shackle will exceed 90-degrees. In some embodiments, the angle made with the housing and shackle will be less than 90-degrees. In some embodiments, you can use a different shaped housing covering or orientation that would still cover the mounting holes. In some embodiments, the lock in the housing uses a variation of different lock types. In some embodiments, the bent arm of the lock can be replaced with an additional lock and slotted end (two lock variation). In some embodiments, the bent arm can be made with various other shapes. In some embodiments, the bent arm end can also be slotted and secure with a pin. In some embodiments, the bent arm can also stay mounted in place to the housing as one piece and swivel together to lock. In some embodiments, the shackle can be larger, wider or smaller, for more security or for more portability. In some embodiments, the shackle can be more elongated, v-shaped, oval, round or square vs. a traditional shape.

Various embodiments of the present invention have one or more of the following objects and/or advantages, though it should be recognized that many embodiments may have fewer than all of the potential advantages yet still provide a useful improvement over existing security devices.

An object of the invention is to provide a solution to skateboarders and other riders having to constantly carry or monitor their skateboards to avoid theft.

Another object of the invention is to provide a solution to the lack of ride-able board locks with u-lock shackles.

An advantage of the invention is that it provides a housing that prevents access to the nuts which attach the trucks to the board so that they cannot be removed while the lock is fastened.

Another advantage of the invention is that it provides a shackle that fits around a standard bike rack or pole.

A further advantage of the invention is that it provides a system that doesn't need to be attached or bolted on to the ride-able board to function.

Another advantage of the invention is that it provides a system that doesn't require any modification of the board to be mounted or used.

Another advantage of the invention is that it can be securely attached to the ride-able board without requiring the use of security nuts and bolts.

Another advantage of the invention is that it provides a system that is easy to disassemble and transport with a lightweight two-piece design.

Another advantage is that it is easy to carry and can fit in back pocket, and can attach to a bet with a clip.

Another advantage is that it clamshells to fit together and provides an easy to carry system.

Another advantage is that it doesn't need to be attached or affixed to a board, so it can easily be used on a different board.

Another advantage is that it doesn't require any attachment or modification to the board, keeping the balance and handling of a board unaffected.

Another advantage is that it utilizes a shackle such as a "U-shackle" or "U-lock" instead of a wire cable.

Another advantage is it works with reverse kingpin trucks.

Another advantage is that it keeps the truck hanger from being disassembled even if the kingpin bolt is removed.

Another advantage is that it doesn't require the skateboard to use security bolts on the mounting nuts or kingpin.

Another advantage is the high level of security compared to past options that use cable locks.

Another advantage is the high level of security compared to past options that don't cover the mounting bolts, allowing easier access.

Another advantage of the invention is that it provides a system that is relatively inexpensive to manufacture with few moving parts.

Additional objects, advantages and novel features of the examples will be set forth in part in the description which follows, and in part will become apparent to those skilled in the art upon examination of the following description and the accompanying drawings or may be learned by production or operation of the examples. The objects and advantages of the concepts may be realized and attained by means of the methodologies, instrumentalities and combinations particularly pointed out in the appended claims.

DETAILED DESCRIPTION OF THE DRAWINGS

The following description of the preferred embodiments of the invention is not intended to limit the invention to these preferred embodiments, but rather to enable any person skilled in the art to make and use this invention. Disclosed herein are an apparatus and system for securing a rideable board to a fixed object.

In the present disclosure, the terms planar body and deck are used interchangeably. The terms truck, steering mechanism and steering apparatus are also used interchangeably.

In some embodiments, a ride-able board may include a planar body and a set of wheels coupled to a bottom portion of the planar body. In some embodiments, the planar body is configured for moving across a solid surface and for carrying a rider. In some embodiments, the board may have four wheels. In some embodiments, the board may have one wheel. In some embodiments, the board may have two wheels. In some embodiments the board may have three, five, six or any multiple of wheels.

In some embodiments of the present invention, a planar body configured for moving across a solid surface and for carrying a rider may be a skateboard, for example a longboard. In general ride-able boards may be motorized, self-propelled, electric, gasoline, wind powered, gravity powered, or unpowered. In general, motorized boards include electric longboards (Boosted Boards, Evolve, Yuneec, Stary, etc.) gasoline powered longboards and skateboards, electric and gasoline powered mountain boards or all-terrain boards, 2-wheel hover boards and inline boards, 1-wheel boards, and other multi-wheel ride-able boards. In general, self-propelled and gravity powered boards include traditional skateboards, longboards, cruising boards and other multi-wheeled ride-able boards. In general, other types of ride-able boards include, wind powered boards, mountain boards and other all-terrain boards.

In general, a ride-able board such as a skateboard may include an apparatus that attaches the wheels to a planar body. This apparatus can be made from multiple materials and can be solid or can be flexible to help steer. The apparatus can also have a swivel mechanism or bearing or bushing to further assist with movement. In general, this will be made from some type of metal and may include two or more per board. In some embodiments of the present invention, a ride-able board, for example a skateboard or longboard, may include a set of trucks to which the wheels are mounted, to provide steering and a solid axle for which the wheels to roll. In some embodiments of the present invention, a ride-able board, for example a longboard will use reverse kingpin trucks. In some embodiments, the ride-able board, for example an electric powered longboard, comprises reverse kingpin trucks having electric motors mounted to them.

Figure 1:
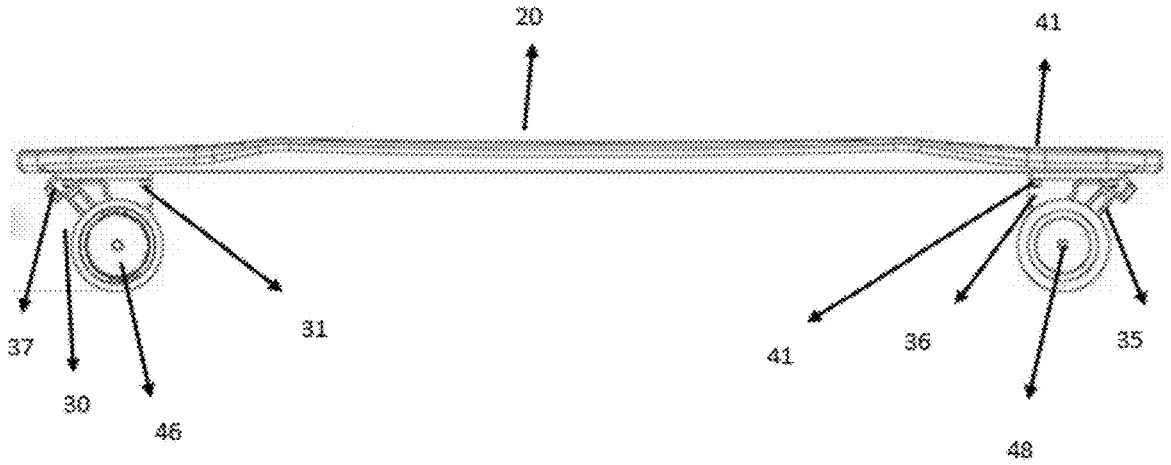
FIG. 1 illustrates a side view of a complete skateboard.
Figure 2:
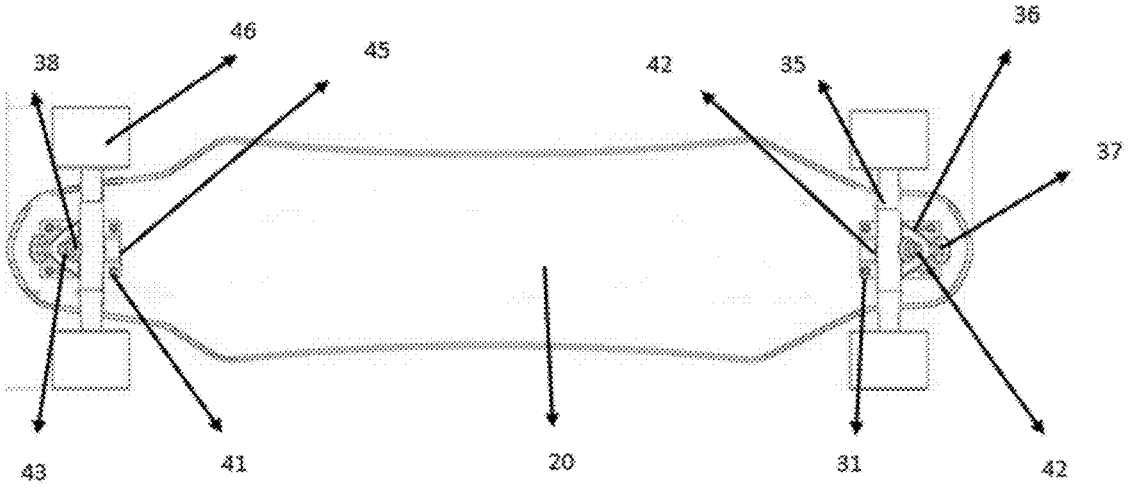
FIG. 2 illustrates a bottom view of a complete skateboard.

FIGS. 1 and 2 show an example of a ride-able board which comprises a planar body or skateboard deck 20 and at least one steering mechanism coupled to the bottom of the deck 20. This steering mechanism may also act as an axle for the wheels on which to spin. In some embodiments, as shown in FIG. 1, a deck 20 is coupled to a set of trucks 30 which are mounted to the underside of the deck 20 by a set of truck mounting bolts 41 which go through the deck from the top of the deck 20 and are secured on the underside of the truck 30 by a set of truck mounting nuts 31. The truck mounting bolts 41 and truck mounting nuts 31 are examples of fasteners which may be used to couple a truck to a planar body. In some embodiments, the trucks 30 comprise the baseplate 36 and the hanger 35, wherein the baseplate is the section against the deck 20 that the truck mounting bolts 41 thread through. In some embodiments, the baseplate 36 mounts flush against the underside of the deck 20. In some embodiments, after threading the truck mounting bolts 41 through the deck 20 and the baseplate 36, the truck mounting nuts 31 screw on and clamp against the baseplate 36 to mount the trucks securely to the underside of the deck 20. In some embodiments, the hanger 35 is attached to the baseplate 36 by the kingpin bolt 42 which threads through the kingpin gap 47 of the baseplate 36 and is secured by the kingpin nut 43. In some embodiments, the base of the hanger 35 rests in the pivot cup 37 and then threads over the kingpin bolt 42 and rests on a various number of washers 38 and bushings 39 that rest on the baseplate 36. In some embodiments, a various number of washers 38 and bushings 39 are placed on top of the hanger, followed by the kingpin nut 43 to securely fasten the hanger 35 to the baseplate 36. In some embodiments, the washers 38 and bushings 39 along with the pivot cup 37 allow the hanger 35 to pivot and swivel which allows the rider to control the function of steering the skateboard. In some embodiments, the hanger 35 extends outwardly to allow wheels 46 to be mounted at the ends of the hanger axle 47 which are then fastened with axle nuts 48.

Figure 3:
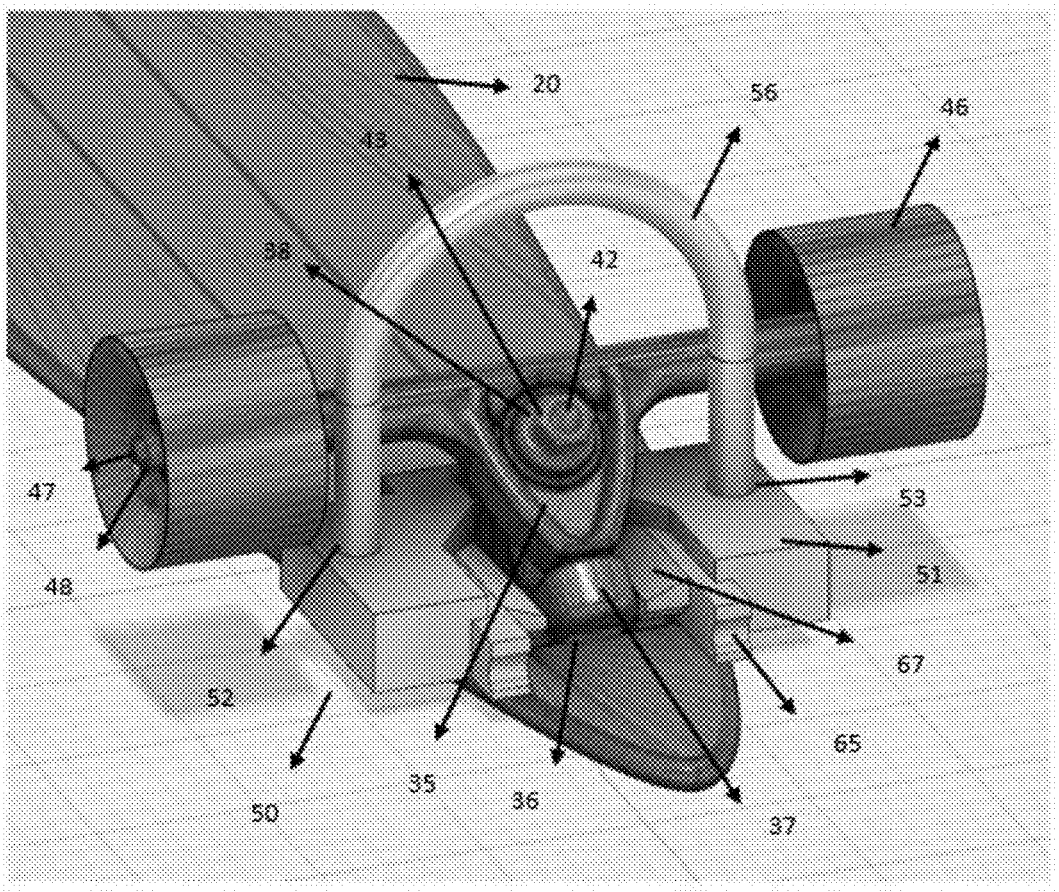
FIG. 3 illustrates a perspective view from the end of a skateboard of the security apparatus mounted on the skateboard in accordance with a preferred embodiment.
Figure 4:
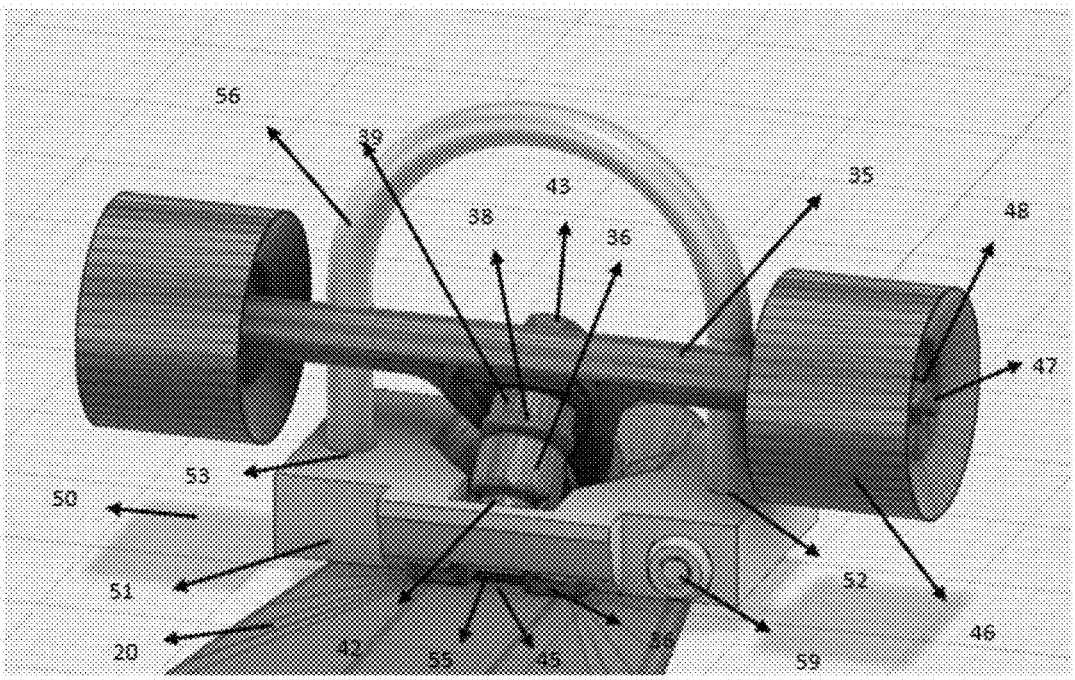
FIG. 4 illustrates a perspective view from the middle of a skateboard of the security apparatus mounted on the skateboard in accordance with a preferred embodiment.
Figure 5:
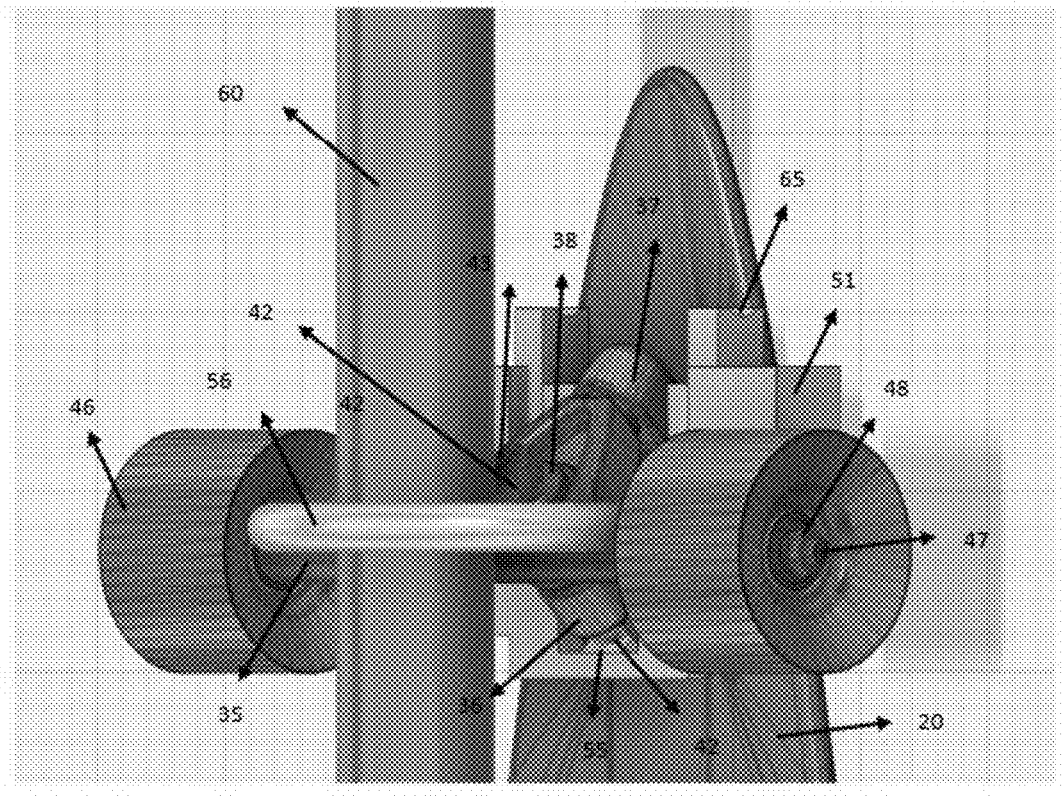
FIG. 5 illustrates side perspective view of security apparatus and skateboard locked to a fixed object in accordance with a preferred embodiment.

In some embodiments, as shown in FIGS. 3, 4 and 5, a locking device 50 is shown mounted to a planar body and a steering mechanism. In some embodiments, as shown in FIGS. 3, 4 and 5, a locking device 50 is shown mounted to a skateboard deck 20 and trucks 30. In some embodiments, the housing 51 is placed against the board 20 resting on top of the baseplate 36 and truck mounting nuts 31. In some embodiments, the housing 51 is slid in between the baseplate 36 and hanger 35 from the kingpin gap 45 side with the lock fixture 59 end pointing towards the middle of the deck 20, with the kingpin key 55 resting in the kingpin gap 45 and the lock hole 52 and L-hook hole 53 past the hanger 35. In some embodiments, the u-shackle 56 is placed around any fixed object for example a pole 60, then the u-shackle 56 is placed into the L-hook hole 53 and then inserted into the lock hole 52 and fastened securely. In some embodiments, once the u-shackle 56 is seated in the lock hole 52, the lock fixture 59 is activated which securely fastens the u-shackle 56 into the housing 51. In some embodiments, the u-shackle 56 now forms a fixed angle with the housing 51 and with the deck 20 itself. In some embodiments, the kingpin key 55 rests securely against the head of the kingpin bolt 42 keeping the housing securely seated on top and within the baseplate 36 of the truck 30 itself. In some embodiments, stops 66 cover the truck mounting nuts 31 and prevent the removal of the housing without lifting it in an upwards direction away from the baseplate. In some embodiments, the housing secures on the baseplate 36 and rests atop the board 20 and truck mounting nuts 31, which once fastened the u-shackle securely arrests the hanger 35 in place. In some embodiments, with the kingpin bolt 42 being securely held by the kingpin key 55 it is now possible to remove the kingpin nut 43 and the hanger 35 will not move as the angle that the u-shackle 56 has now formed keeps it securely in place. In some embodiments, the kingpin key 55 now prevents the kingpin bolt 42 from being removed, as it is securing the hanger 35 between the u-shackle 56 and the baseplate 36, eliminating the need for any security bolts, fasteners, covers, shields or housings for the kingpin nut. In some embodiments, the u-shackles 56 fixed angle in turn keeps the housing 51 in place as to remove the housing 51 you need to raise it in an upwards direction away from the baseplate 36 which is now limited by the hanger 35 and the angle formed between the u-shackle 56 and the baseplate 36. In some embodiments, the stop roof covers 67 the mounting nuts 31 from the top side and prevents them from being tampered with. In some embodiments, the angle fixing the housing 51 in place on top of the baseplate 36, prevents the housing 51 from being raised in an upward direction by the kingpin key 55 and in a rearwards direction by the stops 66 which prevents the mounting nuts 31 from being accessed thus eliminating the need for special security bolts or fasteners. In some embodiments, the mounting nuts 31 and mounting bolts 41 are covered from the bottom allowing the mounting bolts to spin freely if turned from the top of the deck 20 not allowing for engagement and preventing the mounting nuts 31 from being unfastened from the baseplate 36.

In some embodiments, as shown in FIGS. 6, 7, 8, 9, 10 and 11, a locking device 50 or housing 51 is shown. In some embodiments, the locking device 50 is comprised of two main components, namely a housing 51 and a u-shackle 56. In some embodiments, the housing 51 is a semi-hollow or hollow body that encompasses the steering mechanism. In some embodiments, the housing 51 comprises housing arms 51*a*, 51*b* and housing back 51*c* which form a housing slot 51*d* with an open front. The housing arms extend from the housing end on either side of the housing slot. When the locking device is used to secure a ride-able board, the housing arms 51*a*, 51*b* fit over the baseplate, around the kingpin, and/or under the wheels. In general, the open front is towards the end of the skateboard, and the housing back 51*c* is toward the middle of the ride-able board, though it is contemplated that this arrangement could be reversed or modified in another way. The housing slot 51*d* can have a defined height, length and/or width. The height is measured from a top surface of the housing to a bottom surface. In some embodiments, the height H of the housing is from about 10 mm to about 75 mm, alternatively from about 20 mm to about 60 mm. The length is measured from the housing back to the front or the opening of the housing slot. In some embodiments, the length L of the housing is from 20 mm to about 200 mm, alternatively from about 50 mm to about 150 mm. The width is measured between the bottom surfaces of the housing extensions/arms, thereby accommodating the width of the baseplate of the truck. In some embodiments, the width is a major width, and the housing slot also has a minor width between stops on the interior sides of the housing arms/extensions. In some embodiments, the width (or major width) W1 is from about 25 mm to about 100 mm, alternatively from about 35 mm to about 75 mm. In some embodiments, the minor width W2 is from about 15 mm to about 80 mm, alternatively from about 20 mm to about 70 mm. It is contemplated that any of the foregoing minimum and maximum values can be combined to form a range. It is also contemplated that the housings may have any combination of the foregoing lengths, heights and widths.

In some embodiments, the housing encompasses at least a part of the baseplate while the shackle engages the hanger so as to form a rigid device when the shackle locks with the housing. A rigid device can be formed by pressing the housing against the baseplate of the steering apparatus from a first side, and pressing the shackle against the hanger of the steering apparatus from a second side opposing the first side. Because the housing presses against the baseplate and the kingpin of the steering apparatus from a first side, and the shackle presses against the hanger of the steering apparatus from a second side opposing or across from the first side, the locking apparatus forms a rigid device, clamping around the steering apparatus.

Figure 6:
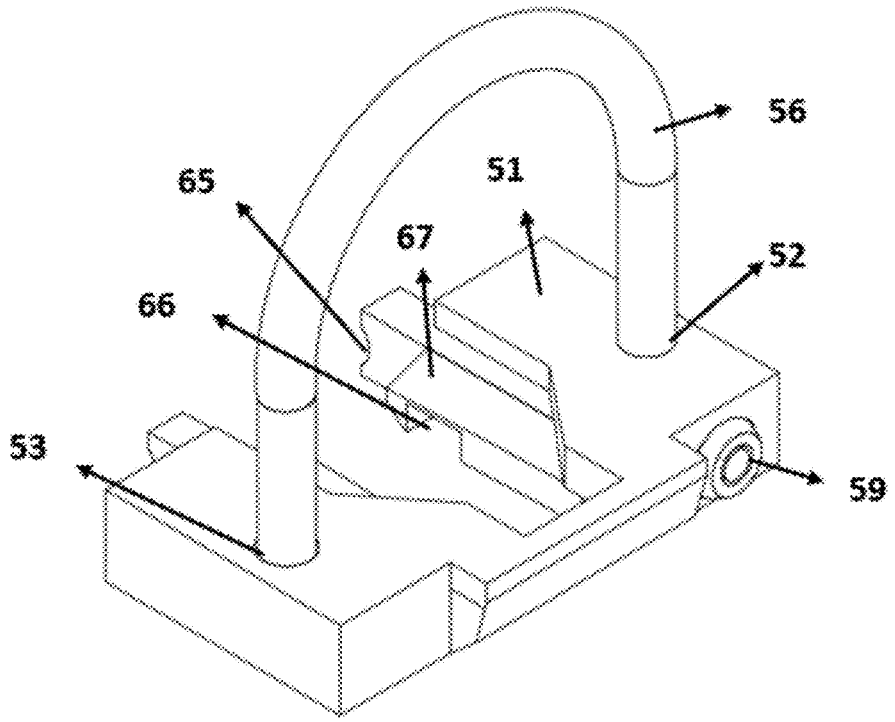
FIG. 6 illustrates front perspective view of security apparatus in locked position in accordance with a preferred embodiment.
Figure 7:
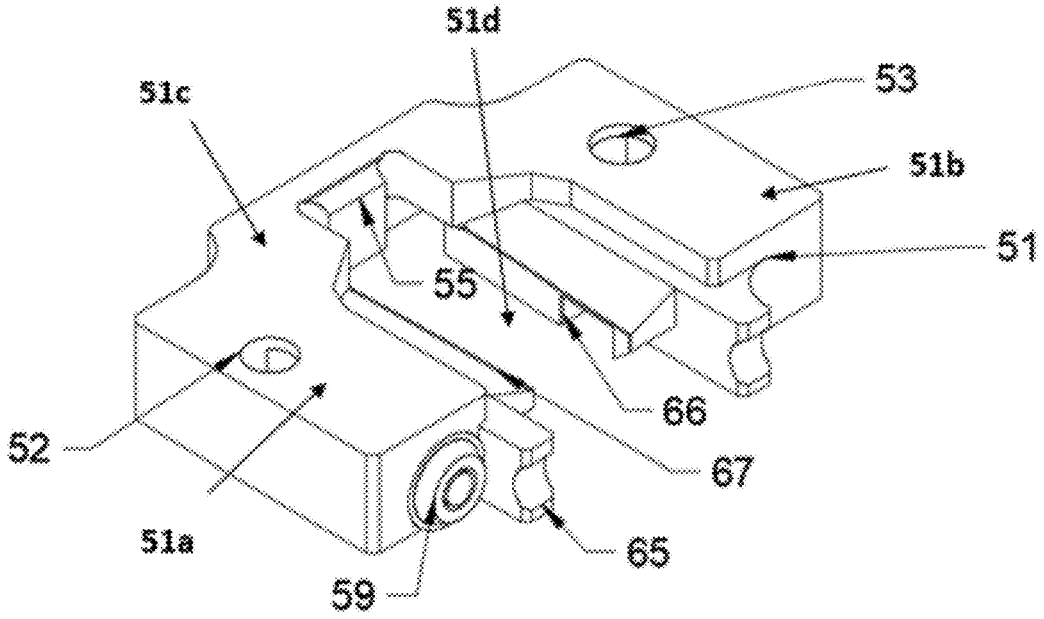
FIG. 7 illustrates rear perspective view of security apparatus in un-locked position in accordance with a preferred embodiment.
Figure 8:
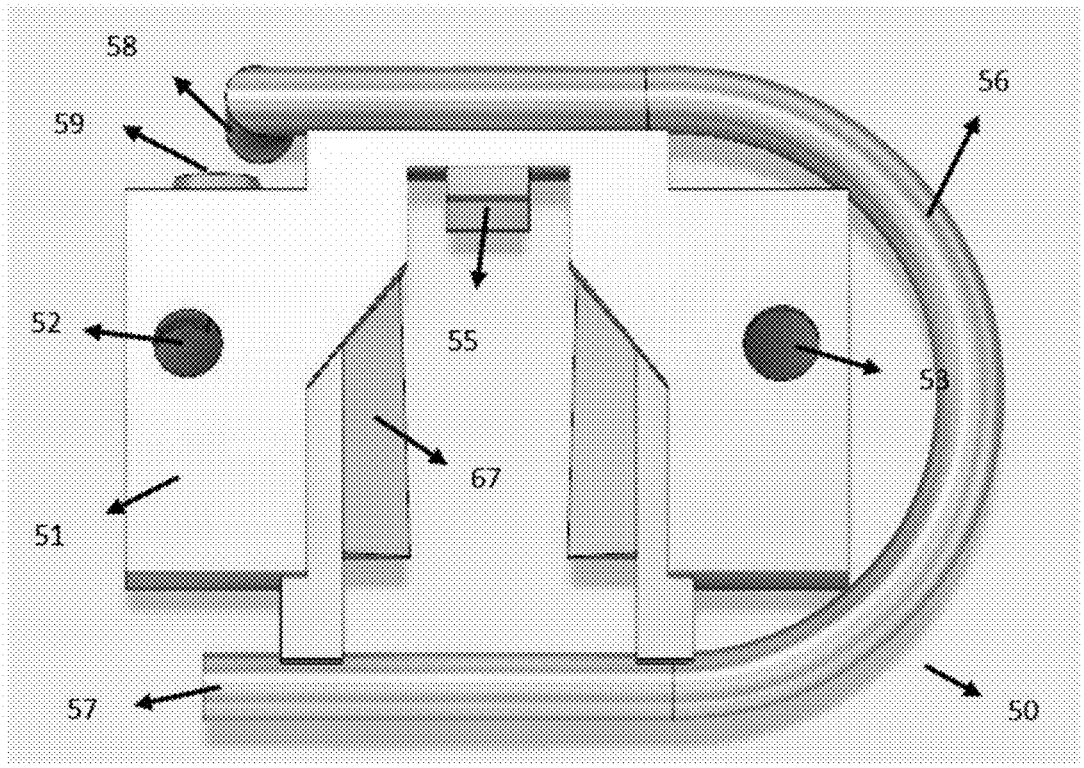
FIG. 8 illustrates top perspective view of security apparatus in carrying clam-shelled position in accordance with a preferred embodiment.
Figure 9:
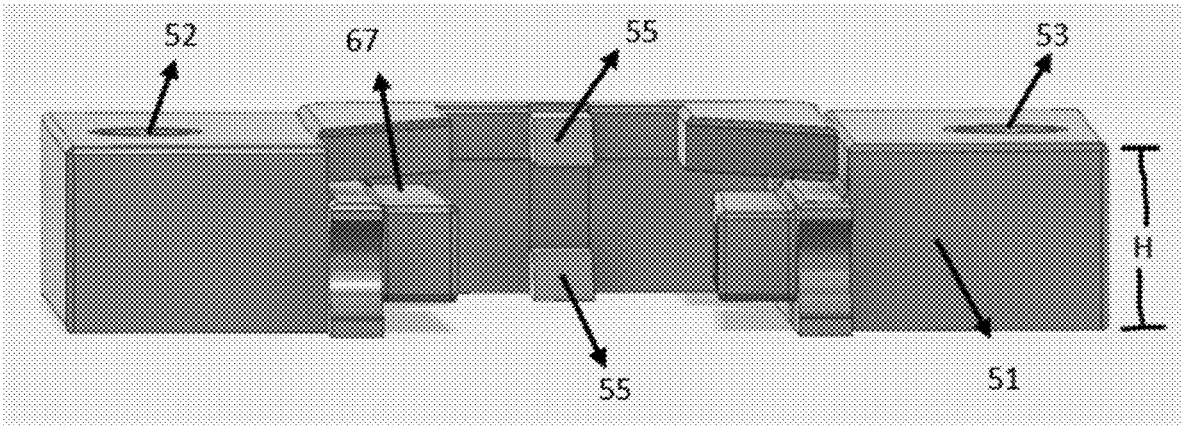
FIG. 9 illustrates rear perspective view of security apparatus housing in accordance with an alternative embodiment.
Figure 10:
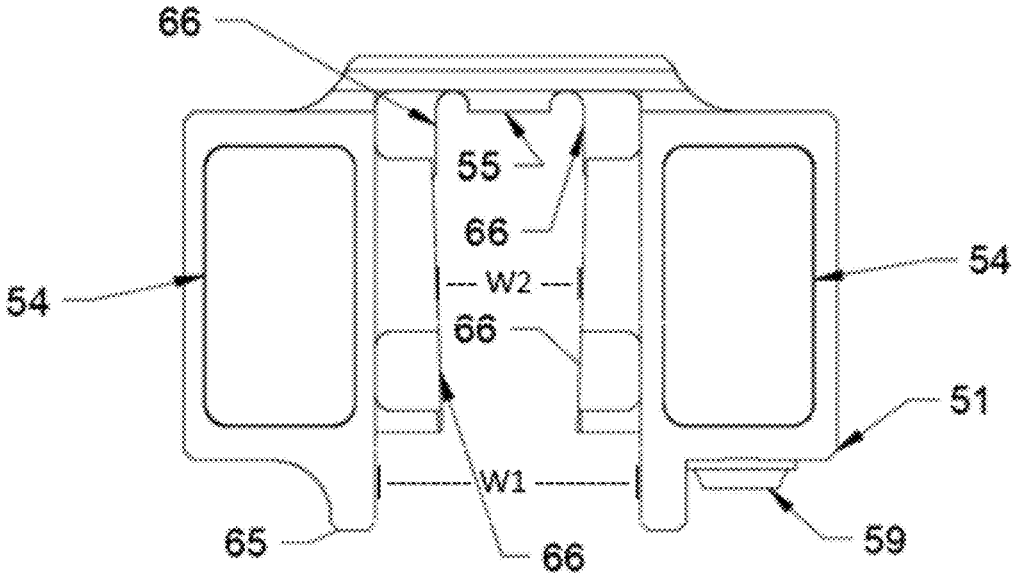
FIG. 10 illustrates bottom perspective view of security apparatus housing in accordance with a preferred embodiment.
Figure 11:
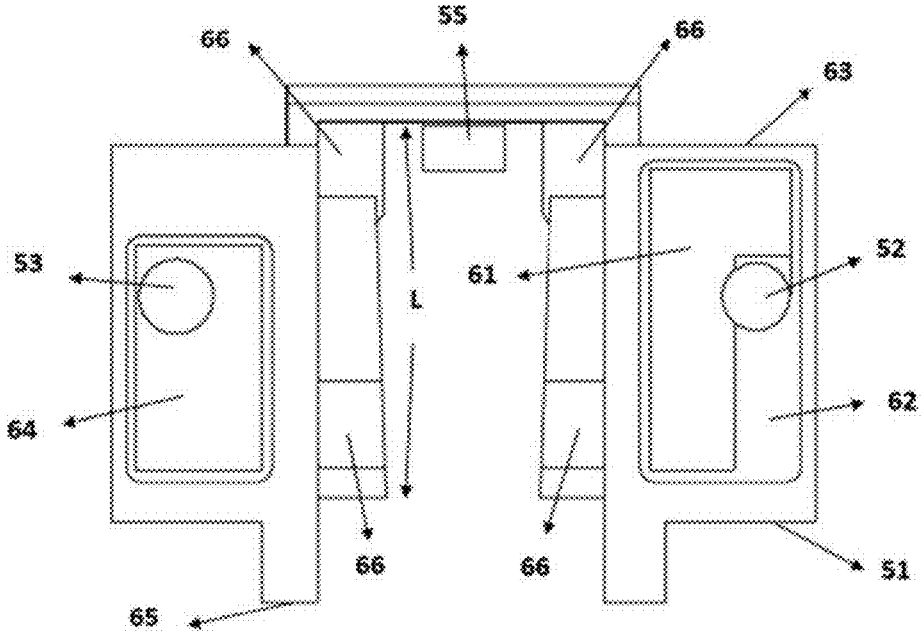
FIG. 11 illustrates bottom perspective view of security apparatus housing with back cover plates removed in accordance with a preferred embodiment.
Figure 12:
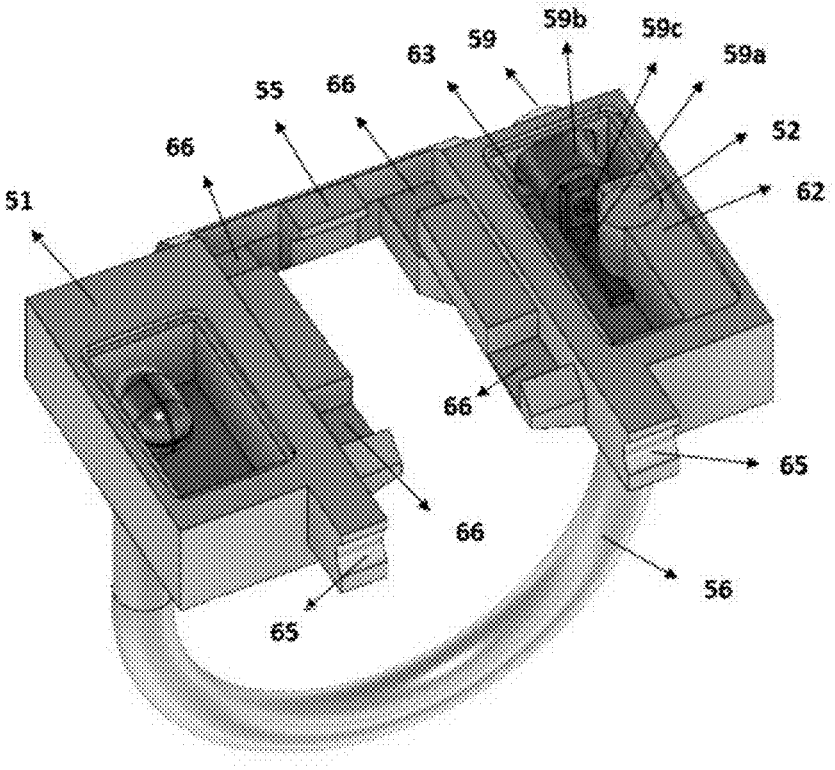
FIG. 12 illustrates another bottom perspective view of security apparatus housing with a locking fixture.

In some embodiments, the housing has a kingpin key (which may be a pin or other protrusion) that sticks or juts out at the end (interior wall) of the housing back (so as to protrude into the housing slot 51*d*). In some embodiments, the housing encompasses at least a part of the baseplate 36 of the truck 30. In some embodiments, each of the housing arms has a hole configured to receive one of the ends of the shackle. In some embodiments, the housing 51 affixes securely to the shackle through two holes in the body, the L-hook hole 53 and the lock hole 52. In some embodiments, on the kingpin key 55 side of the housing a lock fixture 59 is shown, although it can be tubular it can also be combination or placed in a different location. Furthermore, a lock fixture can be provided on the housing front (such as on a housing arm adjacent to the housing slot), or on a side of the housing (along its length), or on any other surface of the housing. In some embodiments, this lock fixture 59 securely fixes the u-shackle 56 to the housing 51 by securing the u-shackle lock side 57 preventing the L-hook side 58 from being removed. In some embodiments, the bottom side of the housing 51 that faces the deck 20 when mounted is enclosed with two hatches 54. In some embodiments, device has have no hatches or only one hatch. In some embodiments, there are also four covered stops 66 that align with the mounting bolts 41 and/or mounting nuts 31. The stops 66 cover and prevent access to the mounting nuts 31 to prevent tampering and affix the housing 51 securely in place. In some embodiments, the stops 66 comprise one or more recessed cavities covered by the stop roof 67, which prevents access to the mounting nuts 31 while allowing them to spin freely in place if the mounting bolts are turned in an attempt to unscrew them. In some embodiments, at the end of the housing there is a kingpin key 55 which juts out and progresses inward at a downward angle. Alternatively, in some embodiments as seen in FIG. 7, multiple kingpin keys 55 are used. In some embodiments, the present invention is a system comprising a housing and one or more removable kingpin keys configured for attachment to the housing. The system may comprise a plurality of kingpin keys of different sizes and/or different shapes, so that the system can be used with trucks of different designs and types. In some embodiments, as seen in FIG. 6 the housing 51 and u-shackle 56 clamshell together for easy carrying and portability. In some embodiments, this allows for the locking device 50 to be placed in the back pocket of jeans or clipped to the belt, it also allows for easy storage in a backpack or other carrying device. In some embodiments, the u-shackle's L-hook side 58 when disengaged from the housing 51 nests into the housing cradle 65 and then swivels towards the kingpin key 55 side, resting against the front of the housing 51. In some embodiments, it can be secured with a hook and loop strap, a detent pin or snap, magnets, or combinations thereof. In some embodiments, on the underside of the housing 51 the two hatches 54 cover the lock fixture cavity 61 and the L-hook cavity 64. In some embodiments, the lock hole cavity 61 comprises a shelf 62 with a shaft on which the u-shackles lock side engages with. In some embodiments, the lock fixture 59 is a tubular lock however it understood that it can be a regular cam lock, combination locks, digital locks, physical locks, biological locks (eye scanner, fingerprint) or other electronic or physical locks. In some embodiments, the lock fixture 59 is secured in the lock fixture cutout 63 through the outside of the housing 51 and has a cam on the end which engages with the u-shackles lock end 57 when turned. This is illustrated in FIG. 12, where the lock fixture 59 comprises cam 509*a* and lock cylinder 59*b*. When lock cylinder 59*b* is turned to a locking position, cam 59*a* engages with the lock end of the u-shackle 56. FIG. 12 also provides a bottom view of a shelf 62, as well as kingpin key 55 and stops 66.

Figure 13:
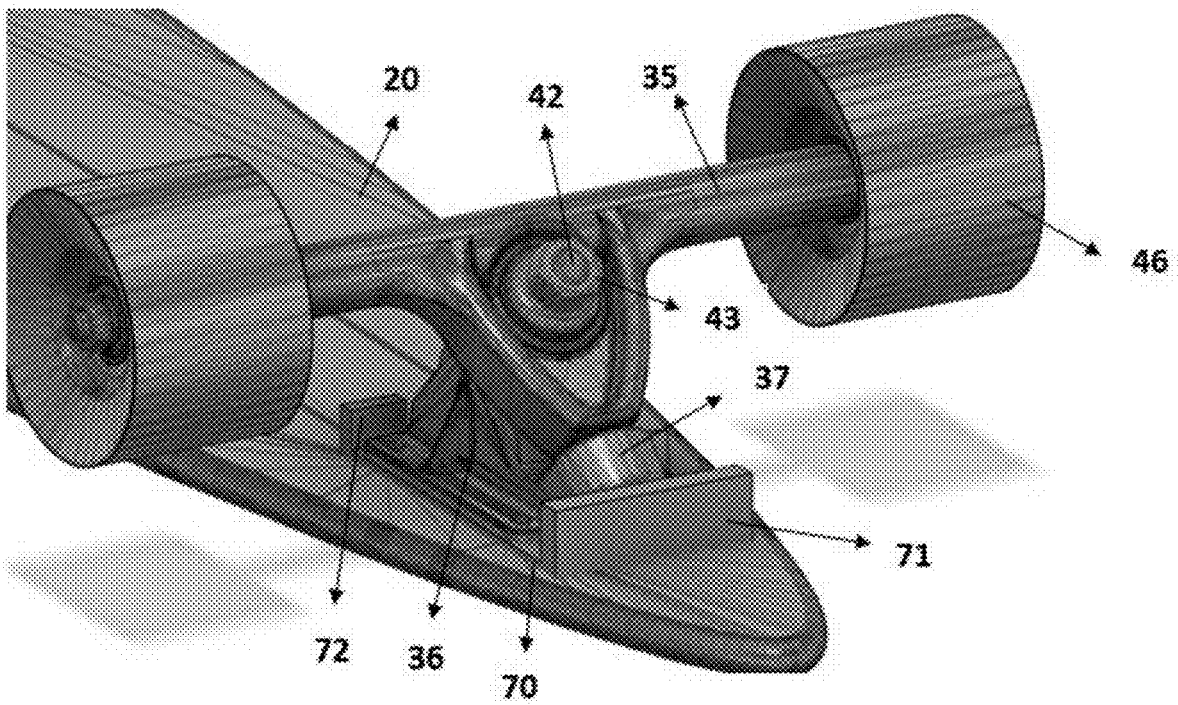
FIG. 13 illustrates a perspective view from the front of a skateboard of another aspect of the security apparatus mounted on the skateboard.
Figure 14:
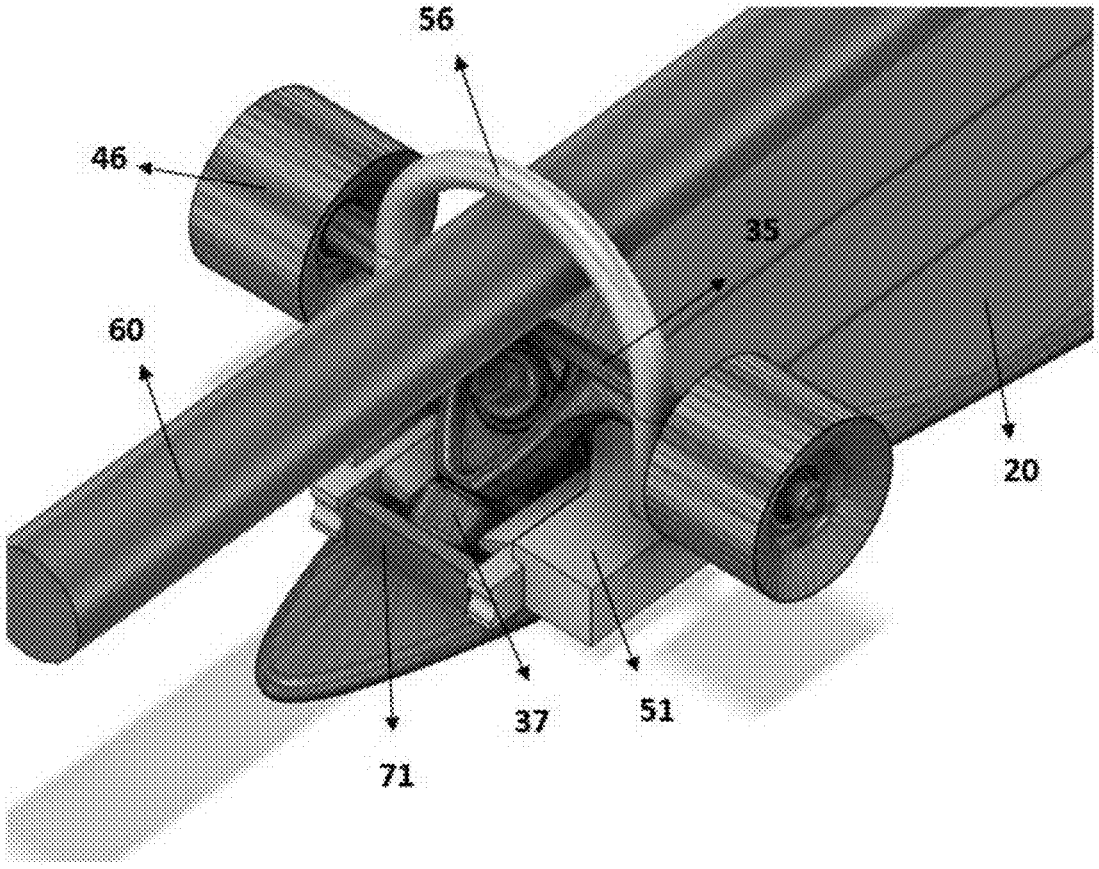
FIG. 14 illustrates a perspective view from the front of a skateboard of the security apparatus with a skateboard locked to a fixed object.
Figure 15:
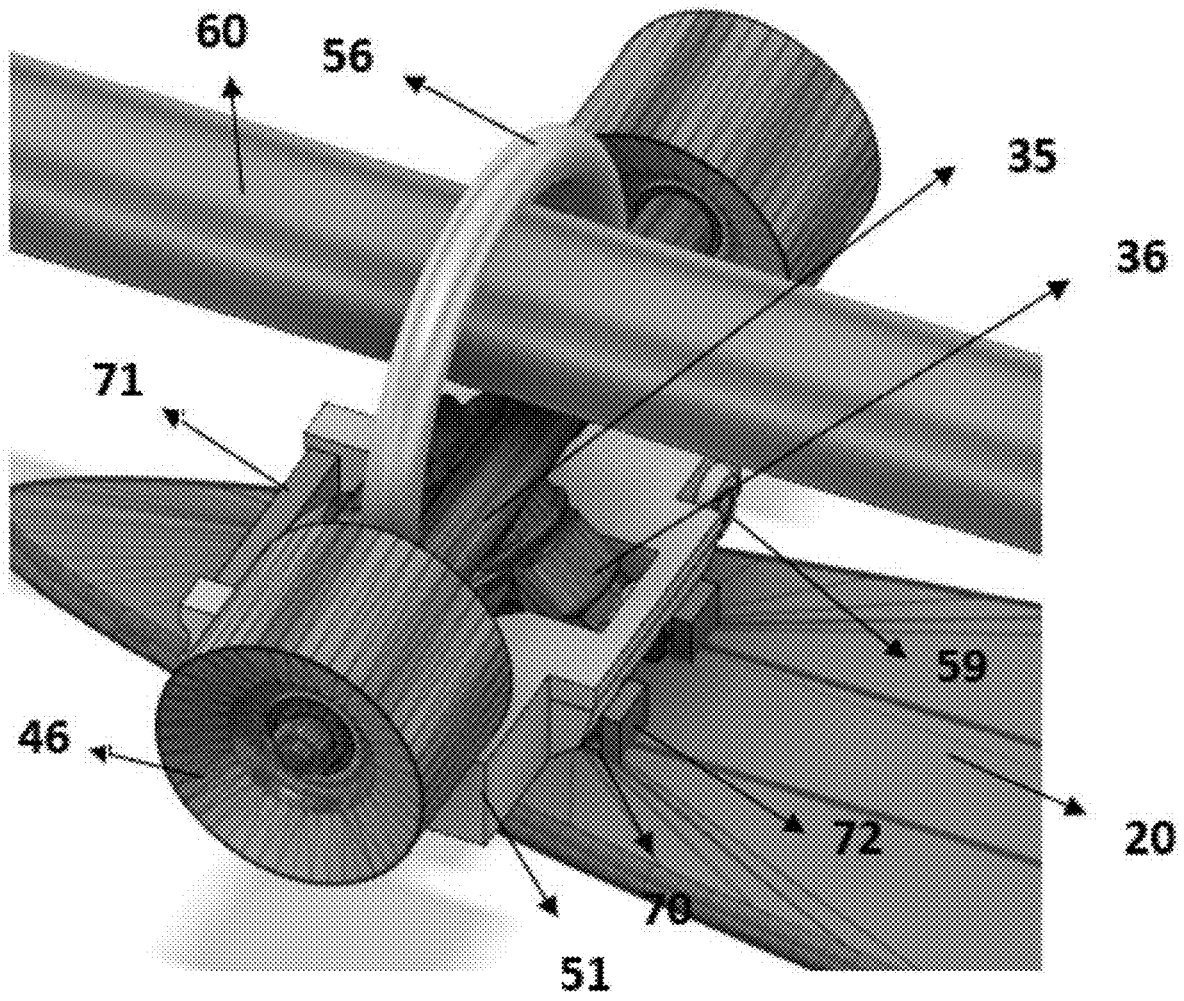
FIG. 15 illustrates a perspective view from the mid-section of a skateboard of the security apparatus with a skateboard locked to a fixed object.

FIGS. 13, 14 and 15 provide perspective views of another aspect of the security apparatus, comprising an optional security plate 70 with locking apparatus and devices described above. The security plate 70 can fastened between the deck 20 and baseplate 36 by the same fasteners used for the deck and baseplate In FIGS. 14 and 15, the security apparatus is ordinarily used to lock a skateboard to a fixed object 60. Housing 51 is positioned around the trucks, and shackle 56 is looped around fixed object 60 and engages hanger 35, and its ends are securely locked in housing 51. In some embodiments, security plate 70 increases the distance between hanger 35 and deck 20, which may facilitate the placement of housing 51 between them. In some embodiments, security plate 70 encompasses and prevents access to a portion of the truck, such as the pivot cup 37 or an end of the kingpin bolt 42, such as by flange 71 or prongs 72 which extend away from the baseplate and toward the truck. The security plate provides additional security by cooperating with the housing to effectively provide a barrier around the truck.

In some embodiments, the lock fixture 59 can be secured in the lock cavity 61 by means of tabs, a screw-and-thread, welding, or other means of attachment. In some embodiments, the hatch 54 is then secured by means of adhesion.

The kingpin key can be any feature or projection configured to engage a kingpin bolt, kingpin nut, or other portion of the kingpin, so as to prevent access to it. In some embodiments the kingpin key is flat or possesses no angle. In some embodiments, the kingpin key is a set of serrated teeth or edges. In some embodiments, the lock hole cavity 61 comprises a shelf which covers the shaft which the u-shackle's lock side engages with. In some embodiments, the hatch 54 is secured by screws or bolts. In some embodiments, the hatch is secured by glue, epoxy, welding or other means of adhesion. In some embodiments, the hatch self-secures or seals when inserted. In some embodiments, the hatch has one or more tabs on either side that insert into a cavity of the housing. In some embodiments, the L-hook cavity 64 comprises a hollowed-out area in the housing. In some embodiments, the housing includes two or more kingpin keys. In some embodiments, the kingpin key can be adjustable by means of a ratcheting or sliding device. In some embodiments, the kingpin key can be removable and replaced. In some embodiments the kingpin key can swivel or pivot to enhance fitment and adjustability. In some embodiments, the housing and u-shackle can be one component which swivels or pivots into position. In some embodiments, the housing comprises the kingpin key and the u-shackle can encompass the locking mechanism. In some embodiments, the shackle can comprise the stop or stops and/or the lock cavity. In some embodiments, the magnets can be replaced with a hook and loop strap or a detent pin. In some embodiments, the number of stops or recessed cavities can be four or less, or two or less. In some embodiments the number of stops or recessed cavities can be more than four, such as six or eight. In some embodiments, the shackle and the housing form a fixed angle when the shackle is locked in the housing. The angle may be formed by a leg of the shackle and a top surface of the housing. In some embodiments, the fixed angle formed by the locking device be 90 degrees. In some embodiments, the fixed angle formed by the locking device may be less than 90 degrees or more than 90 degrees. In some embodiments, the housing and u-shackle may clamshell at an obtuse or acute angle. In some embodiments, the housing may also include a belt dip for easy carrying. In some embodiments, the locking device may also include a belt dip for easy carrying.

Exemplary Embodiments

Exemplary embodiments provided in accordance with the presently disclosed subject matter include, but are not limited to, the claims and the following embodiments:

Embodiment 1

A locking apparatus for a ride-able board, wherein the ride-able board comprises a deck and a truck, and the truck comprises a baseplate coupled to the deck, a kingpin extending from the baseplate away from the deck, and a hanger connected to the kingpin, the locking apparatus comprising: a housing configured to fit between the hanger and the baseplate and to encompass and prevent access to at least a part of the baseplate of the truck, and a shackle comprising a plurality of ends, wherein one or both of the ends is configured for inserting into and locking securely with the housing.

Embodiment 1a

The locking apparatus of embodiment 1, wherein the housing comprises a plurality of housing arms and a housing back connecting the plurality of housing arms.

Embodiment 1b

The locking apparatus of embodiment 1a, wherein the housing arms and housing back together form a housing slot with an open front, wherein the housing arms extend from the housing back on either side of the housing slot.

Embodiment 2

The locking apparatus of embodiment 1, wherein the ride-able board is a skateboard.

Embodiment 2a

The locking apparatus of embodiment 1, wherein the ride-able board is a longboard.

Embodiment 2b

The locking apparatus of embodiment 1, wherein the ride-able board is an electric longboard.

Embodiment 3

The locking apparatus of embodiment 1, wherein the housing comprises one or more stops configured to cover and prevent access to fasteners of the steering apparatus.

Embodiment 3a

The locking apparatus of embodiment 1a, wherein the housing comprises one or more stops in the housing slot, wherein the stops extend from the housing arms.

Embodiment 3b

The locking apparatus of embodiment 3a, wherein each of the stops has one or more recessed cavities, wherein each of the recessed cavities is configured to encompass a fastener when the housing is in place on the ride-able board.

Embodiment 3c

The locking apparatus of embodiment 3a, wherein the stops elevate the housing on top of the steering apparatus and hold the housing in place on the ride-able board.

Embodiment 4

The locking apparatus of embodiment 1, wherein the fasteners of the ride-able board comprise a threaded shaft and a reciprocal threaded nut, and the stops enclose the threaded nuts while allowing them to spin freely (or without interfering or blocking the nuts from spinning freely) if the bolt is turned or unscrewed from the other side of the deck, thus eliminating the need for special security bolts.

Embodiment 5

The locking apparatus of embodiment 1, wherein the housing encompasses at least a part of the baseplate while the shackle engages the hanger so as to form a rigid device when the shackle locks with the housing.

Embodiment 5a

The locking apparatus of embodiment 1, wherein the housing presses against the baseplate and kingpin of the steering apparatus from a first side, and the shackle presses against the hanger of the steering apparatus from a second side opposing the first side.

Embodiment 6

The locking apparatus of embodiment 1, wherein the housing comprises one or more nut stops configured to cover mounting nuts and prevent from dislodging the housing from the base of the steering apparatus.

Embodiment 6a

The locking apparatus of embodiment 1, wherein the housing comprises a clamshell feature configured to hold one or both legs of the shackle.

Embodiment 6b

The locking apparatus of embodiment 6a, wherein the clamshell feature comprises a hook, a loop, a strap, a detent pin, a plastic coupling, a magnet, or a combination thereof.

Embodiment 6c

The locking apparatus of embodiment 1, wherein the locking apparatus comprises a tubular lock in a cavity of the housing, and one of the ends of the shackle is configured to engage the tubular lock, and another of the ends comprises a hook.

Embodiment 7

A ride-able board locking device, wherein the ride-able board comprises a deck and a truck, and the truck comprises a baseplate coupled to the deck, a kingpin extending from the baseplate away from the deck, and a hanger connected to the kingpin, the locking device comprising: a housing configured to fit between the hanger and the baseplate and to encompass and prevent access to at least a part of the baseplate of the truck, and one or more kingpin keys attached to the housing.

Embodiment 7a

The locking device of embodiment 7, wherein the housing comprises a plurality of housing arms and a housing back connecting the plurality of housing arms, wherein the housing arms and housing back together form a housing slot with an open front, and the kingpin key protrudes from the housing back into the housing slot.

Embodiment 8

The locking device of embodiment 7, wherein the ride-able board is a skateboard.

Embodiment 8a

The locking device of embodiment 7, wherein the ride-able board is a longboard.

Embodiment 8b

The locking device of embodiment 7, wherein the ride-able board is an electric longboard.

Embodiment 9

The locking device of embodiment 7, wherein one or more of the kingpin keys is at a different height than another of the kingpin keys, to accommodate different heights of steering apparatus, more particularly of the kingpin.

Embodiment 10

The locking device of embodiment 7, wherein the kingpin key is removably attached to the housing.

Embodiment 11

The locking device of embodiment 7, wherein the kingpin key is adjustable, such as by moving with sliding pins, a ratcheting system or other adjustable embodiment.

Embodiment 12

The locking device of embodiment 7, wherein the kingpin key is removable and configured for attaching to the housing after mounting the housing on the baseplate of the truck.

Embodiment 13

The locking device of embodiment 7, wherein the kingpin key is incorporated or otherwise encompassed into the housing, such as by making a housing with an integral kingpin key.

Embodiment 14

A method for securing a ride-able board with a locking apparatus comprising a housing and a shackle. The method comprises: sliding the housing between the deck and the hanger so as to encompass at least part of the baseplate; positioning the ride-able board near a fixed object and wrapping the shackle around the fixed object; inserting one or both of the ends of the shackle into the housing; and locking the shackle securely in the housing.

Embodiment 14a

The method of embodiment 14, further comprising forming a rigid device by pressing the housing against the baseplate of the steering apparatus from a first side, and pressing the shackle against the hanger of the steering apparatus from a second side opposing the first side.

Embodiment 15

The method of embodiment 14, wherein the ride-able board is a skateboard.

Embodiment 15a

The method of embodiment 14, wherein the ride-able board is a longboard.

Embodiment 15b

The method of embodiment 14, wherein the ride-able board is an electric longboard.

Embodiment 16

The method of embodiment 14, wherein the shackle encompasses and encloses at least a part of the truck, and the housing encompasses a remaining part of the truck while fastening at a midpoint of the housing.

Embodiment 17

The method of embodiment 14, wherein the housing and the shackle are locked in a secure fitment.

Embodiment 18

The method of embodiment 14, wherein forming a rigid device comprising the housing and shackle wherein the shackle is stressed against the hanger, thereby securing the components of the truck.

Embodiment 19

The method of embodiment 14, further comprising unlocking the shackle and forming a clamshell arrangement of the housing and the shackle.

Embodiment 20

The method of embodiment 19, wherein the clamshell arrangement is formed by engaging the shackle with a hook, a loop, a strap, a detent pin, a plastic coupling, a magnet, or a combination thereof on the housing.

The examples and illustrations included herein show, by way of illustration and not of limitation, specific embodiments in which the subject matter may be practiced. Other embodiments may be utilized and derived therefrom, such that structural and logical substitutions and changes may be made without departing from the scope of this disclosure. Such embodiments of the inventive subject matter may be referred to herein individually or collectively by the term "invention" merely for convenience and without intending to voluntarily limit the scope of this application to any single invention or inventive concept, if more than one is in fact disclosed. Thus, although specific embodiments have been illustrated and described herein, any arrangement calculated to achieve the same purpose may be substituted for the specific embodiments shown. This disclosure is intended to cover any and all adaptations or variations of various embodiments. Combinations of the above embodiments, and other embodiments not specifically described herein, will be apparent to those of skill in the art upon reviewing the above description.

What is claimed:

1. A locking apparatus for a ride-able board, wherein the ride-able board comprises a deck and a truck, and the truck comprises a baseplate coupled to the deck, a kingpin extending from the baseplate away from the deck, and a hanger connected to the kingpin, the locking apparatus comprising:

a housing configured to fit between the hanger and the baseplate and to encompass and prevent access to at least a part of the baseplate of the truck, a shackle comprising a plurality of ends, wherein one or both of the ends is configured for inserting into and locking securely with the housing, and a lock fixture in the housing configured to securely fasten the shackle to the housing when the lock fixture is activated.

2. The locking apparatus of claim 1, wherein the ride-able board is a skateboard or a longboard.

3. The locking apparatus of claim 1, wherein the housing comprises one or more stops configured to cover and prevent access to fasteners of the truck to the ride-able board.

4. The locking apparatus of claim 3, wherein the fasteners of the truck to the ride-able board comprise a threaded shaft and a reciprocal threaded nut, and the stops enclose the threaded nuts while allowing them to spin freely or without interfering or blocking the nuts from spinning freely if the threaded shaft is turned or unscrewed from the other side of the deck.

5. The locking apparatus of claim 1, wherein the housing encompasses at least a part of the baseplate while the shackle engages the hanger so as to form a rigid device when the shackle locks with the housing.

6. The locking apparatus of claim 1, wherein the housing comprises one or more nut stops configured to cover mounting nuts and prevent from dislodging the housing from the base of the steering apparatus.

7. A ride-able board locking device, wherein the ride-able board comprises a deck and a truck, and the truck comprises a baseplate coupled to the deck, a kingpin extending from the baseplate away from the deck, and a hanger connected to the kingpin, the locking device comprising:

a housing configured to fit between the hanger and the baseplate and to encompass and prevent access to at least a part of the baseplate of the truck, and one or more kingpin keys attached to the housing, wherein said one or more kingpin keys comprises a protrusion that sticks or juts out at an interior wall of the housing.

8. The locking device of claim 7, wherein the ride-able board is a skateboard or a longboard.

9. The locking device of claim 7, wherein one or more of the kingpin keys is at a different height than another of the kingpin keys, to accommodate different heights of steering apparatus, more particularly of the kingpin.

10. The locking device of claim 7, wherein the kingpin key is removably attached to the housing.

11. The locking device of claim 7, wherein the kingpin key is adjustable, such as by moving with sliding pins, a ratcheting system or other adjustable embodiment.

12. The locking device of claim 7, wherein the kingpin key is removable and configured for attaching to the housing after mounting the housing on the baseplate of the truck.

13. The locking device of claim 7, wherein the integral kingpin key is incorporated or otherwise encompassed into the housing.

14. A method for securing a ride-able board with a locking apparatus comprising a housing and a shackle, wherein the method comprises:

sliding the housing between the deck and the hanger so as to encompass at least part of the baseplate;

positioning the ride-able board near a fixed object and wrapping the shackle around the fixed object;

inserting one or both of the ends of the shackle into the housing; and locking the shackle securely in the housing.

15. The method of claim 14, wherein the ride-able board is a skateboard or a longboard.

16. The method of claim 14, wherein the shackle encompasses and encloses at least a part of the truck, and the housing encompasses a remaining part of the truck while fastening at a midpoint of the housing.

17. The method of claim 14, wherein the housing and the shackle are locked in a secure fitment.

18. The method of claim 14, wherein forming a rigid device comprising the housing and shackle wherein the shackle is stressed against the hanger, thereby securing the components of the truck.

19. The method of claim 14, further comprising unlocking the shackle and forming a clamshell arrangement of the housing and the shackle.

20. The method of claim 19, wherein the clamshell arrangement is formed by engaging the shackle with a hook, a loop, a strap, a detent pin, a plastic coupling, a magnet, or a combination thereof on the housing.

* * * * *